US005118314A

United States Patent [19]

Mangone et al.

[11] Patent Number: 5,118,314

[45] Date of Patent: Jun. 2, 1992

[54] FUSE HOLDER

[75] Inventors: Barry L. Mangone, Marble Falls; George H. Oakley, Burnet, both of Tex.

[73] Assignee: Gould, Inc., Eastlake, Ohio

[21] Appl. No.: 696,832

[22] Filed: May 7, 1991

[51] Int. Cl.[5] ..... H01R 13/00

[52] U.S. Cl. ..... 439/830

[58] Field of Search ..... 439/830-833

[56] References Cited

U.S. PATENT DOCUMENTS

| | | | |
|---|---|---|---|
| 790,883 | 5/1905 | Buchanan . | |
| 945,017 | 1/1910 | Cole . | |
| 1,805,487 | 5/1931 | Johnson . | |
| 1,938,097 | 12/1933 | Curlee | 200/134 |
| 1,953,806 | 4/1934 | Jackson | 200/166 |
| 2,114,523 | 4/1938 | Cleveland | 200/134 |
| 2,175,987 | 10/1939 | Dodge | 200/121 |
| 2,243,741 | 5/1941 | Rowe | 200/134 |
| 2,476,886 | 7/1949 | Miller et al. | 173/324 |
| 2,729,802 | 1/1956 | Jordan et al. | 339/256 |
| 3,082,399 | 3/1963 | Brandhorst | 339/259 |
| 3,198,913 | 8/1965 | Stanback | 200/119 |
| 3,265,830 | 8/1966 | Kobryner | 200/114 |
| 3,335,399 | 8/1967 | Rys | 339/219 |
| 3,575,566 | 4/1971 | Rys | 200/162 |
| 3,588,413 | 6/1971 | Stanback | 200/166 |
| 3,815,071 | 6/1974 | Sleeter | 337/215 |
| 3,829,807 | 8/1974 | Krueger | 337/143 |
| 3,927,927 | 12/1975 | Salzer et al. | 339/125 |
| 4,037,917 | 7/1977 | Clement | 339/259 |
| 4,097,114 | 6/1978 | Motten, Jr. | 339/259 |
| 4,257,662 | 3/1981 | Motten, Jr. | 339/186 |
| 4,500,162 | 2/1985 | Keglewitsch et al. | 339/252 |
| 4,950,195 | 8/1990 | Perreault et al. | 439/830 |

*Primary Examiner*—Joseph H. McGlynn

*Attorney, Agent, or Firm*—Fish & Richardson

[57] ABSTRACT

A fuse holder having a base made of insulating material, a block having a planar contact surface for contacting a blade terminal of a fuse and two holes that are located on opposite sides of the surface and extend along axes parallel to the surface, one hole being a mounting hole extending through the block, the other the hole being a retainer hole ending at a transverse wire receiving hole, a resilient member that is retained on the block and has an arm that is biased toward the planar contact surface, a connector located in the mounting hole and securing the block to the base, and a wire retainer located in the retainer hole.

17 Claims, 1 Drawing Sheet

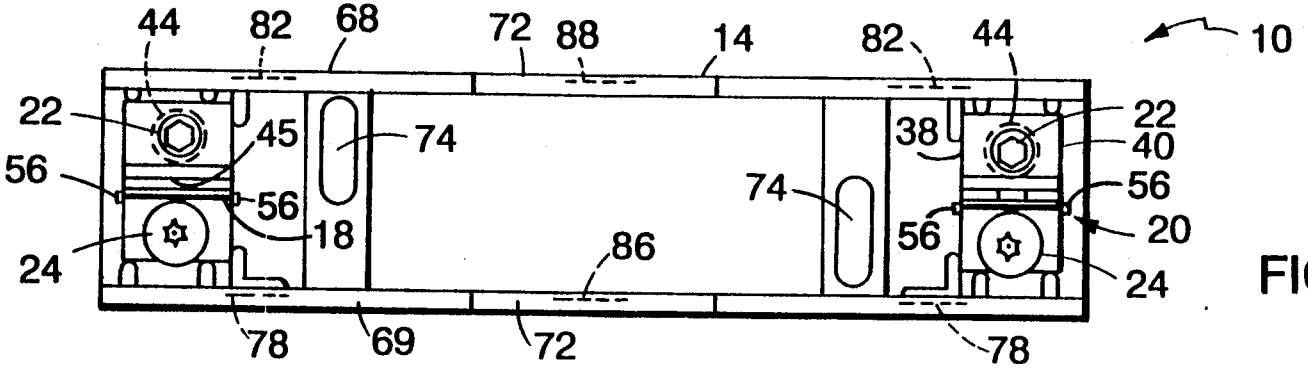
FIG. 1
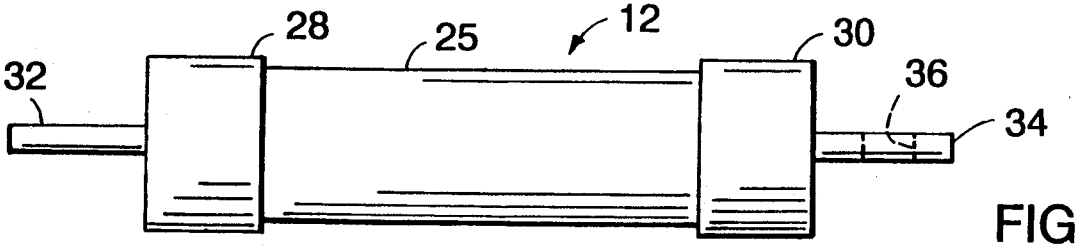
FIG. 2
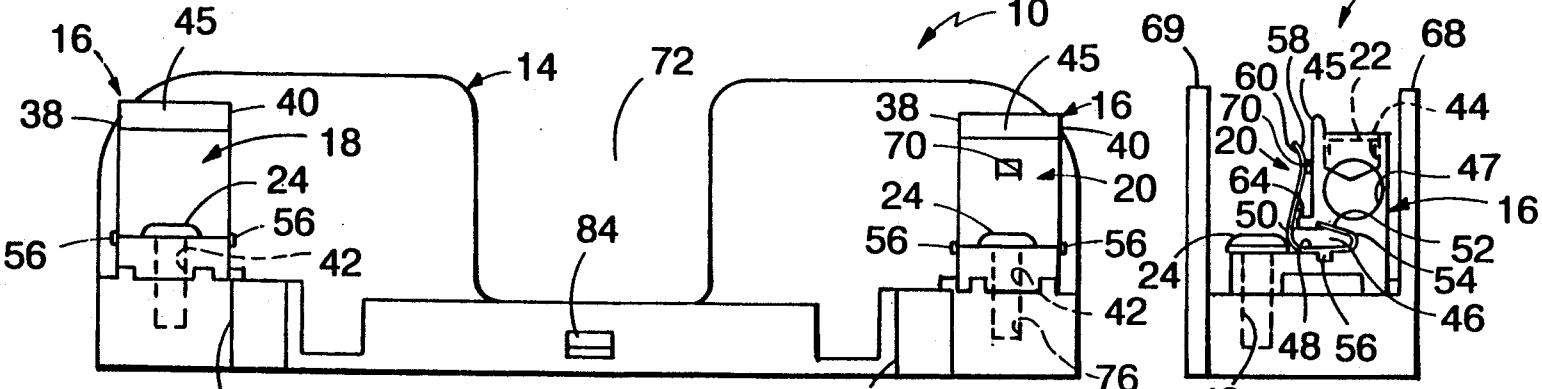
FIG. 3
FIG. 4

FUSE HOLDER

BACKGROUND OF THE INVENTION

The invention relates to a fuse holder for an elongated fuse having blade type terminals at the ends of a fuse casing.

Fuses having blade type terminals extending from two ends of the fuse casing are often held in fuse holders having a base of insulating material and two conductive members at the ends of the base that engage the fuse blades and provide electrical connection of the blades to wires.

SUMMARY OF THE INVENTION

The invention features, in general, a fuse holder including a conductive block that is mounted on an insulating base and carries a resilient conductive member to engage a fuse blade between the resilient member and a planar contact surface of the block. The block has two holes that are located on opposite sides of the planar surface and extend along axes parallel to the planar surface. One hole is a mounting hole that extends through the block, and the other hole is a retention hole that ends at a transverse wire receiving hole. A connector (e.g., a bolt or screw) located in the mounting hole secures the block to the base. A wire retainer (e.g., a set screw) in the retention hole retains the end of an electrical wire in the wire receiving hole. Such an arrangement conserves space, because the region on the two sides of the blade (which is occupied by the fuse casing over the rest of the base) is used for mounting and wire retention, and the block does not have to extend too far on either side or too far beyond the end of the blade to provide these functions. Also, by having both the wire retainer hole and mounting hole be accessible from the same side, the assembly and manufacture of the fuse holder are simplified.

In preferred embodiments, the block has a uniform cross section in planes perpendicular to the planar surface and perpendicular to the axis of the wire receiving hole, with the exception of the mounting hole and retainer hole. The block is made from an extrusion that has been cut at planes perpendicular to the planar surface and perpendicular to the wire receiving hole and has been drilled to provide the mounting hole and the retainer hole. The block has a recess that receives a mounting portion of the resilient member. The recess has a front entrance to it and a stop surface behind the front entrance that engages a spring-loaded bent portion of the mounting portion to restrain the mounting portion from moving out through the front entrance. The recess is open at two sides, and the mounting portion has two bent tabs that extend out of the side openings and engage the side surfaces of the block to prevent the mounting portion from moving out through the side openings. The end of the arm of the resilient member has an angled guide surface to guide the fuse blade between it and the planar surface, and the block has a stop member that limits travel of the arm of the resilient member to permit insertion of the blade between it and the planar contact surface. The insulating base has projections that engage side surfaces of the block and prevent the block from rotating about the axis of the mounting hole. The base also has side walls with gaps permitting access to the central body portion of a fuse held therein. One of the side walls is removable, and the base has connectors permitting connection to an adjacent base of a different fuse holder. The base also has mounting holes for mounting the holder on a support surface. The fuse holder has two blocks and two resilient bodies, one resilient member having a tab that fits within a notch in a blade of the fuse.

Other advantages and features of the invention will be apparent from the following description of the preferred embodiment thereof and from the claims.

DESCRIPTION OF THE PREFERRED EMBODIMENT

The preferred embodiment will now be described.

DRAWINGS

FIG. 1 is a plan view of a fuse holder according to the invention.

FIG. 2 is a plan view of a fuse that can be held by the FIG. 1 fuse holder.

FIG. 3 is a front elevation of the FIG. 1 fuse holder with a removable side wall removed.

FIG. 4 is a side elevation of the FIG. 1 fuse holder.

STRUCTURE, MANUFACTURE, AND OPERATION

Referring to the drawings, there is shown fuse holder 10 for holding fuse 12. Fuse holder 10 includes insulating base 14 (made of polycarbonate), two blocks 16, two resilient members 18, 20 (best shown in FIG. 4), two set screws 22 and two mounting screws 24 (self-tapping screws). Fuse 12 includes fuse casing 26 and two end terminals 28, 30 that have blades 32, 34, respectively, blade 34 having notch 36 therein, which notch is used on a certain class of fuse.

Blocks 16 are made from copper or an extruded piece of aluminum that has been cut at surfaces 38, 40 and has been drilled to provide mounting holes 42 and retainer holes 44. Mounting hole 42 is on one side of planar contact surface 45, and retainer hole 44 is on the other side of surface 45. Retainer hole 44 ends at transverse wire receiving hole 47. Each block 16 has recess 46 that receives mounting portion 48 of resilient member 18 or 20. Recess 46 has front entrance 50 to it and stop surface 52 that engages spring-loaded bent portion 54 of resilient member 18 or 20 to restrain mounting portion 48 from moving out through front entrance 50. Recess 46 is open at two sides, and mounting portion 48 has two bent tabs 56 that extend out of the side openings and engage side surfaces 38, 40 of block 16 to prevent mounting portion 48 from moving out through the side openings.

Resilient members 18 and 20 have bent back guide surfaces 58 at the ends of their arms 60 to guide fuse blades between arms 60 and planar surfaces 45 of blocks 16. Block 16 has a stop member 64 that limits travel of arm 60, permitting insertion of blade 32 or 34 between arm 60 and planar surface 45. Resilient member 20 has tab 70 for mating with notch 36 of blade 34. (When the fuse holder is designed for use with a fuse that does not have a notch, tab 70 is not used.) The region between surface 45 and arm 60 is a flat blade region that receives blade 32 or 34.

Base 14 has projections 66 that engage side surfaces of blocks 16 and prevent the blocks from rotating about the axes of mounting holes 42. Side walls 68, 69 of base 14 have gaps 72 permitting access to the central portion of casing 26 of a fuse 12 held therein. Side wall 69 is removable (it has been removed in FIG. 3) and is connected to the rest of base 14 via mating of mortises 78 on side wall 69 and tenons 80 on base 14. Side wall 68 has mortises 82 for mating with tenons 80 on an adjacent base 14 of a different fuse holder when it is desired to connect a plurality of fuse holders 10 together. Snap 84 on base 14 mates with recess 86 or 88 to hold wall 69 or an adjacent base 14, respectively, in place. Base 14 also has mounting holes 74 for mounting holder 10 on a support surface and threaded holes 76 receiving screws 24.

Locating holes 42, 44 on both sides of surface 45 acts to conserve space, because the regions on the two sides of the blade 32 or 34 are used for mounting and wire retention. These two regions already need to be provided between walls 68, 69, as the corresponding regions over the rest of base 14 are occupied by fuse casing 26. Blocks 16 do not need to extend too far on either side of surface 45 or beyond the end of the blade to provide these functions.

In manufacture, blocks 16 are made from an extruded piece of metal that has a cross section that is the same as the surface shown in FIG. 4; it thus already has hole 47 through it. The extrusion is cut at surfaces 38 and 40, and the cut piece is placed in a fixture and drilled from the top to provide holes 42, 44. Hole 44 is tapped to provide a thread for engaging set screw 22 while the piece is in the same fixture. Having wire retainer hole 44 and mounting hole 42 be accessible from the same side thus acts to simplify the manufacture procedure, as it permits all finishing operations to be done with a single setup. Blocks 16 are tin plated.

Resilient members 18 and 20 are cut and formed from a piece of 0.030" thick spring steel sheet metal that is plated with zinc after manufacture for corrosion protection. The angle between bent portion 54 and the remainder of mounting portion 48 before assembly is larger than the angle after inserting into recess 46. When bent portion is inserted into recess 46 through entrance 50 it is resiliently deflected downward, causing it to be springloaded with an upward bias. This prevents bent portion 54 from easily moving downward so as to clear stop surface 52, thus preventing removal of mounting portion 48 through entrance 50. The angle between arm 60 of resilient member 20 and the lower section of mounting portion 48 is less before mounting on block 16 than it is after mounting, causing arm 60 to be preloaded with a spring force against stop member 64 before insertion of blade 32 or 34. Blocks 16 are positioned on base 14 against projections 66, and screws 24 are screwed into holes 76. The stripped end of an electrical wire (not shown) is inserted into hole 47, and retained by tightening set screw 22. Because holes 42, 44 are accessible from the same side, the assembly of the fuse holder is simplified.

In use, fuse 12 is placed in holder 10, and blade 32 is resiliently engaged between arm 60 of resilient member 18 and facing planar contact surface 45, and blade 34 is resiliently engaged between arm 60 of resilient member 20 and facing planar contact surface 45. Blades 32 and 34 rest against the upper surfaces of stop members 64. Tab 70 of resilient member 20 is received in slot 36, insuring that an improper fuse is not used.

Other embodiments of the invention are within the scope of the following claims.

What is claimed is:

1. A fuse holder for holding an elongated fuse having a blade type terminal extending from a central portion of an end thereof, said fuse holder comprising a base made of insulating material, a block having a planar contact surface for contacting a fuse blade located in a flat blade region partially bounded by said surface, said block also having two holes that are located on opposite sides of the plane of said surface and extend along axes parallel to said surface, one said hold being a mounting hole extending through said block, the other said hole being a retainer hole ending at the side of a transverse wire receiving hole, said block being a unitary member made of a single, integral piece of material, said block having a top side and a bottom side, said bottom side of said block being mounted on said base, both said holes being accessible from the top side of said block, a resilient member that is retained on said block and has an arm that is biased toward said surface, a connector located in said mounting hole and securing said block to said base, and a wire retainer located in said retainer hole.

2. The fuse holder of claim 1 wherein said resilient member has an arm and an end of said arm that has an angled guide surface to guide said fuse blade between said arm and said planar contact surface.

3. The fuse holder of claim 1 wherein said fuse holder has two said blocks and two said resilient members, one resilient member having a tab for mating with a notch in a blade of said fuse.

4. The fuse holder of claim 1 wherein said base has a removable side wall.

5. The fuse holder of claim 1 wherein said base has integral connectors permitting connection to an adjacent base of a different fuse holder.

6. The fuse holder of claim 1 wherein said block has a uniform cross section in planes perpendicular to said planar contact surface and perpendicular to an axis of said wire receiving hole, with the exception of said mounting hole and said retainer holes.

7. The fuse holder of claim 6 wherein said block is made from an extrusion that has been cut at planes perpendicular to said planar contact surface and perpendicular to said axis of said wire receiving hole and has been drilled to provide said mounting hole and said retainer hole.

8. The fuse of claim 6 wherein said block has an L-shaped cross-section, said mounting hole being located in a lower area than said retainer hole.

9. The fuse holder of claim 1 wherein said resilient member has a mounting portion, and said block has a recess that receives said mounting portion of said resilient member.

10. The fuse holder of claim 9 wherein said mounting portion has a spring-loaded bent portion, said recess has a front entrance to it, and said block has a stop surface behind said front entrance that engages said spring-loaded bent portion to restrain said mounting portion from moving out through said front entrance.

11. The fuse holder of claim 9 wherein said recess has side openings at two side surfaces of said block, and said mounting portion has two bent tabs that extend out of said side openings and engage said side surfaces to prevent said mounting portion from moving out through said side openings.

12. The fuse of claim 9 wherein said recess has a surface that is coplanar with a surface at which said mounting hole begins.

13. The fuse holder of claim 1 wherein said resilient member has an arm, and said block has a stop member that limits travel of said arm of said resilient member to permit insertion of said blade between it and said planar surface.

14. The fuse holder of claim 13 wherein said arm has a preloaded force when resting against said stop member.

15. The fuse holder of claim 1 wherein said block has side surfaces, and said base has projections that engage said side surfaces of said block and prevent said block from rotating about an axis of said mounting hole.

16. The fuse holder of claim 15 wherein said base has side walls with gaps permitting access said central portion of a fuse held therein.

17. The fuse holder of claim 16 wherein said base also has mounting holes for mounting said fuse holder on a support surface.

* * * * *

UNITED STATES PATENT AND TRADEMARK OFFICE

CERTIFICATE OF CORRECTION

PATENT NO. : 5,118,314
DATED : June 2, 1992
INVENTOR(S) : Barry L. Mangone, et. al.

It is certified that error appears in the above-indentified patent and that said Letters Patent is hereby corrected as shown below:

On the Title page, item [56] under Reference Cited, insert the following:

| | | | |
|---|---|---|---|
| U.S. Patent No. 3,171,002 | 02/1965 | Kinnear | 439/830 |
| U.S. Patent No. 3,289,144 | 11/1966 | Bachman | 439/830 |
| U.S. Patent No. 4,775,338 | 10/1988 | Norden | 439/831 |
| U.S. Patent No. 4,059,334 | 11/1977 | Baily | 439/831 |

Marathon Special Products product sheet

Signed and Sealed this

Nineteenth Day of October, 1993

*Attest:*

Bruce Lehman

BRUCE LEHMAN

*Attesting Officer*

*Commissioner of Patents and Trademarks*